US008978183B1

(12) United States Patent
Richmond et al.

(10) Patent No.: US 8,978,183 B1
(45) Date of Patent: Mar. 17, 2015

(54) POCKETED SPRING ASSEMBLY

(71) Applicant: L&P Property Management Company, South Gate, CA (US)

(72) Inventors: Darrell A. Richmond, Carthage, MO (US); Thomas W. Wells, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/150,444

(22) Filed: Jan. 8, 2014

(51) Int. Cl.
*A47C 16/00* (2006.01)
*A47C 27/06* (2006.01)
*A47C 23/04* (2006.01)

(52) U.S. Cl.
CPC ..... *A47C 27/064* (2013.01); *A47C 23/04* (2013.01)
USPC ..... 5/655.8

(58) Field of Classification Search
CPC ..... A47C 23/002; A47C 27/064
USPC ..... 5/562, 246, 248, 256, 261, 268, 716, 5/721, 654.1, 720, 655.8
See application file for complete search history.

(56) References Cited

U.S. PATENT DOCUMENTS 1,284,384 A * 11/1918 Lewis ..... 5/720
3,633,228 A 1/1972 Zysman
4,485,506 A 12/1984 Stumpf et al.
4,523,344 A * 6/1985 Stumpf et al. ..... 5/655.8
4,895,352 A 1/1990 Stumpf
5,303,530 A * 4/1994 Rodgers ..... 53/114
5,319,815 A * 6/1994 Stumpf et al. ..... 5/720
6,021,627 A 2/2000 Mossbeck et al.
6,122,900 A * 9/2000 Mossbeck et al. ..... 53/529
6,159,319 A 12/2000 Mossbeck
6,336,305 B1 1/2002 Graf et al.
6,398,199 B1 * 6/2002 Barber ..... 267/93
6,408,514 B1 * 6/2002 Mossbeck et al. ..... 29/896.92
6,591,436 B2 7/2003 de Santis et al.
6,668,406 B2 * 12/2003 Spinks et al. ..... 5/655.8
6,826,796 B1 * 12/2004 Mossbeck ..... 5/720
6,829,798 B2 12/2004 Wells
7,048,263 B2 5/2006 Ahlqvist
7,194,777 B2 * 3/2007 Edling et al. ..... 5/720
7,908,693 B2 * 3/2011 DeMoss ..... 5/720
8,464,381 B2 6/2013 Mossbeck
2004/0103479 A1 * 6/2004 Mossbeck et al. ..... 5/720
2005/0257323 A1 * 11/2005 Edling et al. ..... 5/720
2005/0273939 A1 * 12/2005 Mossbeck ..... 5/720
2007/0289068 A1 * 12/2007 Edling ..... 5/720
2010/0257675 A1 * 10/2010 DeMoss ..... 5/720

FOREIGN PATENT DOCUMENTS

WO 2008/145185 12/2008
WO 2013/060983 5/2013

* cited by examiner

*Primary Examiner* — Nicholas Polito
*Assistant Examiner* — Richard G Davis
(74) *Attorney, Agent, or Firm* — Wood, Herron & Evans, LLP

(57) ABSTRACT

A pocketed spring assembly comprises a plurality of parallel strings of springs, each string joined to an adjacent string, each string comprising first and second opposed plies of fabric and a plurality of pockets formed along a length of the string by transverse seams joining the first and second plies, and at least one spring positioned in each pocket. At least one said string has a single spring in one pocket and a pair of nested springs in an adjacent pocket in alternating fashion along the length of the string, the pair of nested springs having a taller spring and a shorter spring. A portion of each transverse seam forming the adjacent pockets of the at least one string is divided from an upper surface of the at least one string downwardly so as to partially separate the adjacent pockets.

26 Claims, 5 Drawing Sheets

POCKETED SPRING ASSEMBLY

RELATED APPLICATIONS

N/A

FIELD OF THE INVENTION

This invention relates generally to bedding and seating products, and more particularly to pocketed spring assemblies used in bedding and seating products.

BACKGROUND OF THE INVENTION

Mattress spring core construction over the years has been a continuously improving art with advancements in materials and machine technology. A well known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

More recently, improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds instead of stitching are used to form the pockets encapsulating the springs.

Once strings of pocketed springs are constructed, they may be assembled to form a spring core construction for a mattress, cushion or the like by a variety of methods. For example, multiple or continuous strings may be arranged in a row pattern corresponding to the desired size and shape of a mattress or the like and adjacent rows of strings may be interconnected by a variety of methods. The result is a unitary assembly of pocketed coil springs serving as a complete spring core assembly.

One improvement upon pocketed coil springs as described is a compound nested pocketed coil spring in which each pocket of a string includes two nested coil springs. In such designs, a first inner spring is typically shorter and smaller than a second outer spring. The first inner spring is nested within the second outer spring. Commonly, the inner spring of the nested compound spring unit is individually encased in a pocketed fabric material to minimize noise or interference during the flexing or compression of the compound spring unit.

Spring core constructions employing compound nested pocketed springs provide the advantage of offering differing degrees of hardness to the spring unit. Varying degrees of hardness are usually achieved by varying the number of springs per unit area, commonly referred to as the "spring count" of the unit, or by changing the gauge of the wire from which the springs are manufactured. The inner and outer coil springs are nested so that the lower portion of the combined spring unit is reinforced by the inner spring making this portion of the unit much stronger than the upper portion. The upper portion may be flexible enough to provide a resilient and comfortable seating or sleeping surface and the lower portion strong enough to absorb abnormal stresses, weight concentrations or shocks without discomfort or damage.

Notwithstanding the above, there remains room for improvement in spring core construction.

SUMMARY OF THE INVENTION

In one aspect, a bedding or seating product is provided. The product comprises a pocketed spring assembly comprising a plurality of parallel strings of springs, each string joined to an adjacent string, each string comprising first and second opposed plies of fabric and a plurality of pockets formed along the length of the string by transverse seams joining the first and second plies, and at least one spring positioned in each pocket. At least one string has a single spring in one pocket and a pair of nested springs in an adjacent pocket in alternating fashion along the length of the string, the pair of nested springs having a taller spring and a shorter spring. A portion of each transverse seam forming the adjacent pockets of the at least one string is divided from an upper surface of the spring assembly downwardly so as to partially separate the adjacent pockets. Cushioning materials are placed on the pocketed spring assembly, and an upholstered covering encases the pocketed spring assembly and cushioning materials.

Each transverse seam separating the adjacent pockets of the at least one string can be divided from the upper surface of the spring assembly downwardly to below an uppermost portion of the shorter spring. Each spring can have upper and lower end turns and a plurality of central convolutions between the end turns. The strings of springs can extend longitudinally or transversely. If transversely, the product can include a plurality of the strings having a single spring in one pocket and a pair of nested springs in an adjacent pocket in alternating fashion along the length of the string, the plurality of strings arranged in a plurality of zones longitudinally spaced apart. For example, the product can include five such zones. The five zones can comprise a central zone, a pair of head end zones, and a pair of foot end zones. The central zone can have four strings of springs having a single spring in one pocket and a pair of nested springs in an adjacent pocket in alternating fashion along the length of strings, and each of the head end zones and foot end zones can have two strings of springs having a single spring in one pocket and a pair of nested springs in an adjacent pocket in alternating fashion along the length of the strings. The strings of springs having a single spring in one pocket and a pair of nested springs in an adjacent pocket in alternating fashion along the length of strings can be arranged such that the single springs and the nested springs are staggered relative to one another longitudinally.

In another aspect, a pocketed spring assembly for a bedding or seating product is provided. The pocketed spring assembly comprises a plurality of parallel strings of springs, each string joined to an adjacent string, each string comprising first and second opposed plies of fabric and a plurality of pockets formed along the length of the string by transverse seams joining the first and second plies, and at least one spring positioned in each pocket. At least one string has a single spring in one pocket and a pair of nested springs in an adjacent pocket in alternating fashion along the length of the string, the pair of nested springs having a taller spring and a shorter spring. A portion of each transverse seam forming the adjacent pockets of the at least one string is divided from an upper surface of the spring assembly downwardly so as to partially separate the adjacent pockets.

In another aspect, a string of springs for a pocketed spring assembly for a bedding or seating product is provided. The string of springs comprises first and second opposed plies of fabric and a plurality of pockets formed along the length of the string by transverse seams joining the first and second plies. A single spring is positioned in one pocket and a pair of nested springs is positioned in an adjacent pocket in alternating fashion along the length of the string, the pair of nested springs having a taller spring and a shorter spring. A portion of each transverse seam forming the adjacent pockets is divided from an upper surface of the string of springs downwardly so as to partially separate the adjacent pockets.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
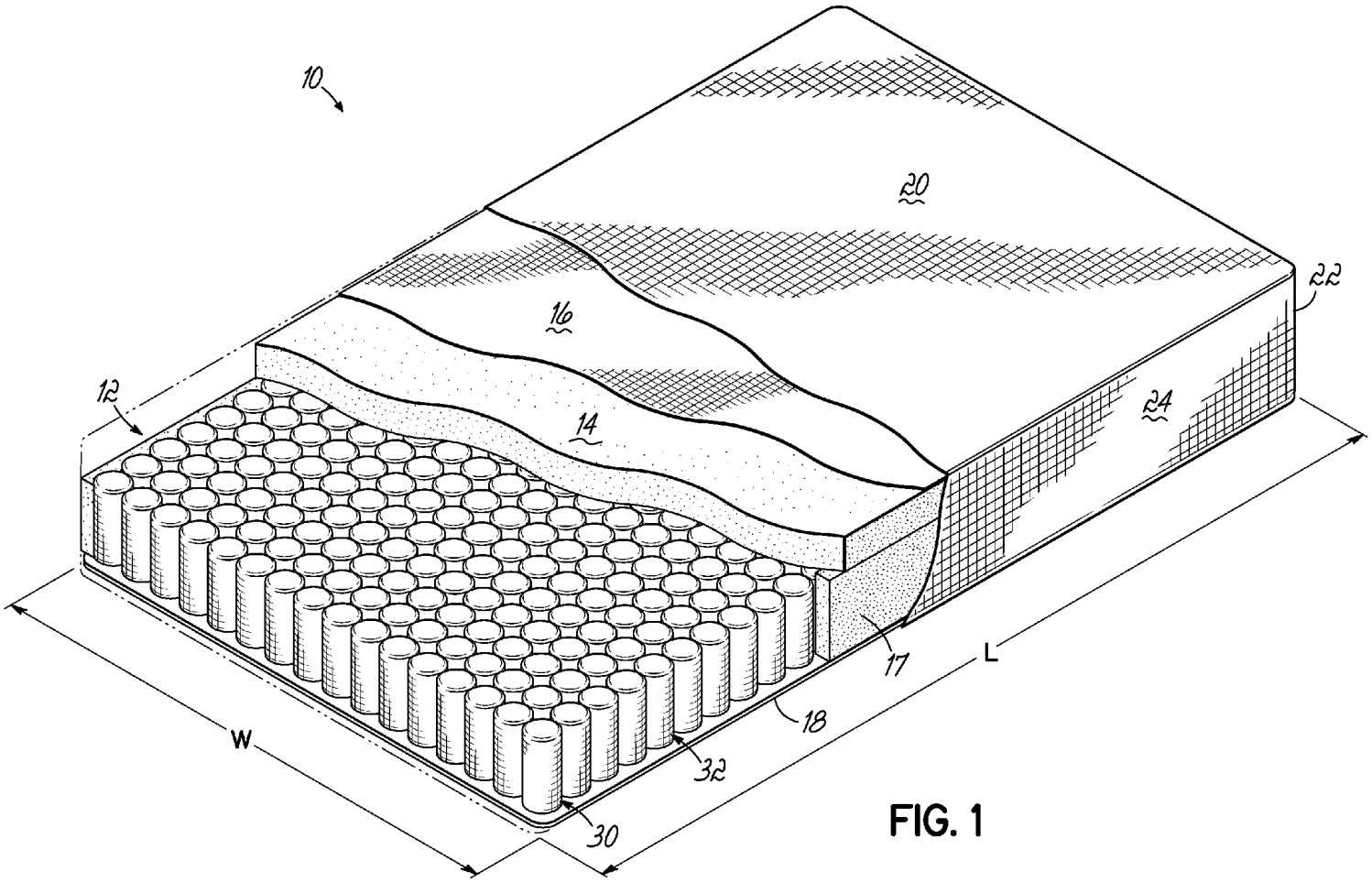
FIG. 1 is a perspective view, partially broken away, of a bedding or seating product incorporating a pocketed spring assembly according to the principles of the present invention.

Referring first to FIG. 1, there is illustrated a bedding product in the form of a single-sided mattress 10 incorporating the principles of the present invention. This product or mattress 10 comprises a pocketed spring assembly 12 over the top of which there lay conventional padding or cushioning layers 14, 16 which may be foam, fiber, gel or any other suitable materials. The pocketed spring assembly 12 is surrounded with a border 17 made of foam or any other suitable material (only a portion being shown in FIG. 1). Although one type of border 17 is illustrated, the border may assume other forms or shapes of any desired size. Alternatively, the border 17 may be omitted in this embodiment or any embodiment described or shown herein. This complete assembly is mounted upon a base 18 and is completely enclosed within an upholstered covering material 20. The base 18 and border 17 are known in the industry as a "bucket" into which a pocketed spring assembly 12 is inserted before the "bucket" is covered with one or more padding or cushioning layers.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1 the length is illustrated as being greater than the width. However, it is within the scope of the present invention that the length and width may be identical, as in a square product.

As shown in FIG. 1, pocketed spring assembly 12 is manufactured from multiple strings 30, 32 of pocketed springs joined together. String 30 is formed of pocketed single springs 34, and string 32 is formed from pocketed single springs 34 and pocketed compound nested springs 36 that alternate along the length of the string 32. Each string 30, 32 of pocketed springs extends from side-to-side or transversely across the full width of the product 10. Although the strings 30, 32 of pocketed springs are illustrated as extending transversely or from side-to-side in the pocketed spring assembly 12 of FIG. 1, they may extend longitudinally or from end-to-end in this or any other pocketed spring assembly shown or described herein.

These strings 30, 32 of pocketed springs are connected in side-by-side relationship as, for example, by gluing the sides of the strings together in an assembly machine, so as to create an assembly or matrix of springs having multiple rows and columns of pocketed springs bound together as by gluing, welding or any other conventional assembly process commonly used to create pocketed spring cores or assemblies.

Figure 4:
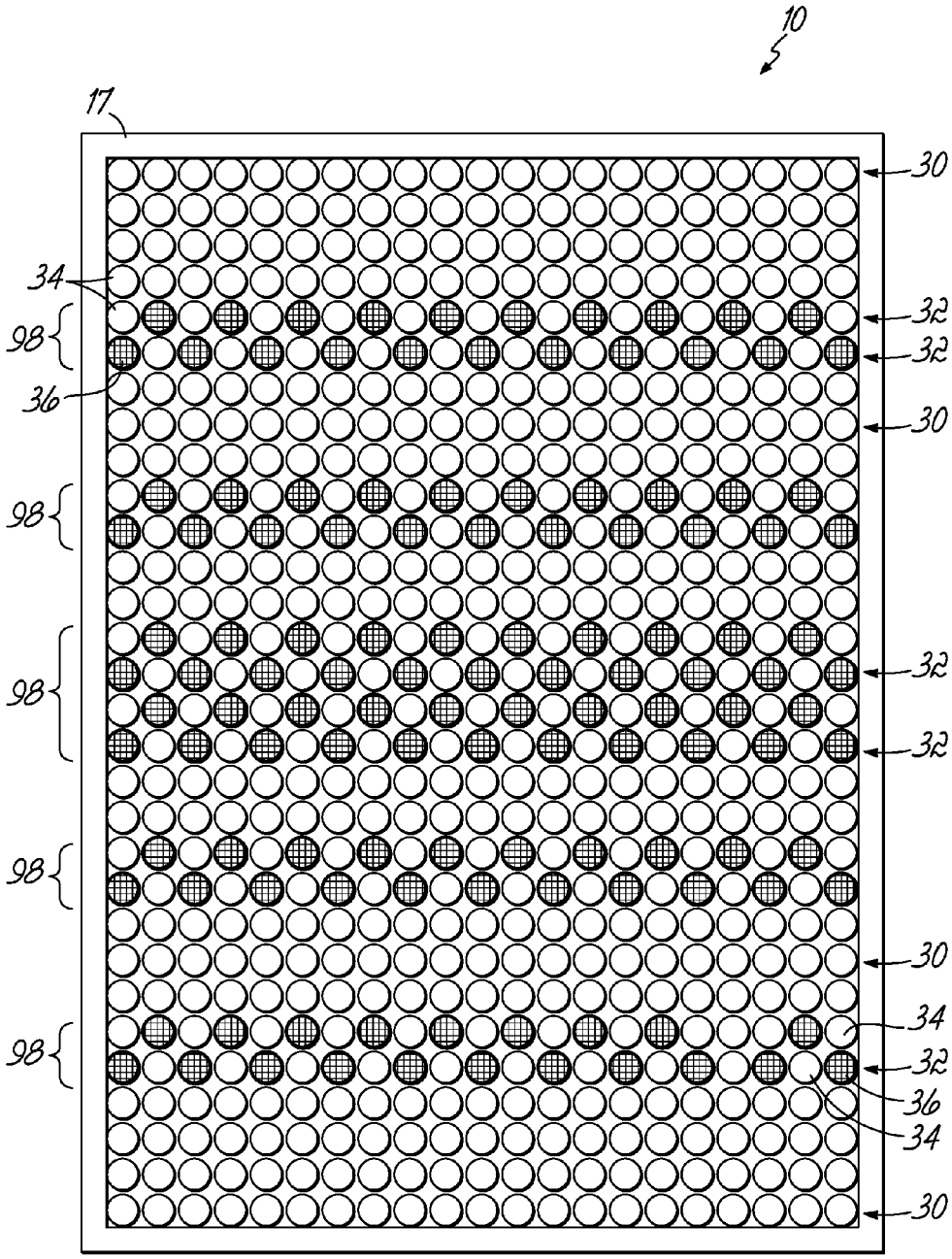
FIG. 4 is a top view of the pocketed spring assembly of FIG. 1.

Referring to FIGS. 1 and 4, the strings 30, 32 of pocketed springs may be joined so that the individually pocketed springs are aligned in transversely extending rows and longitudinally extending columns. Alternatively, the strings 30, 32 of pocketed springs may be offset from one another in a pocketed spring assembly. In such an arrangement, the individually pocketed springs are not aligned in rows and columns; instead the individually pocketed springs fill gaps or voids of the adjacent strings of pocketed springs.

While the mattress 10 illustrated in FIG. 1 is a single-sided mattress, the pocketed spring assembly 12, or any other pocketed spring assembly shown or described herein, may be incorporated into any bedding or seating product, including a double-sided mattress or seating cushion.

Figure 2:
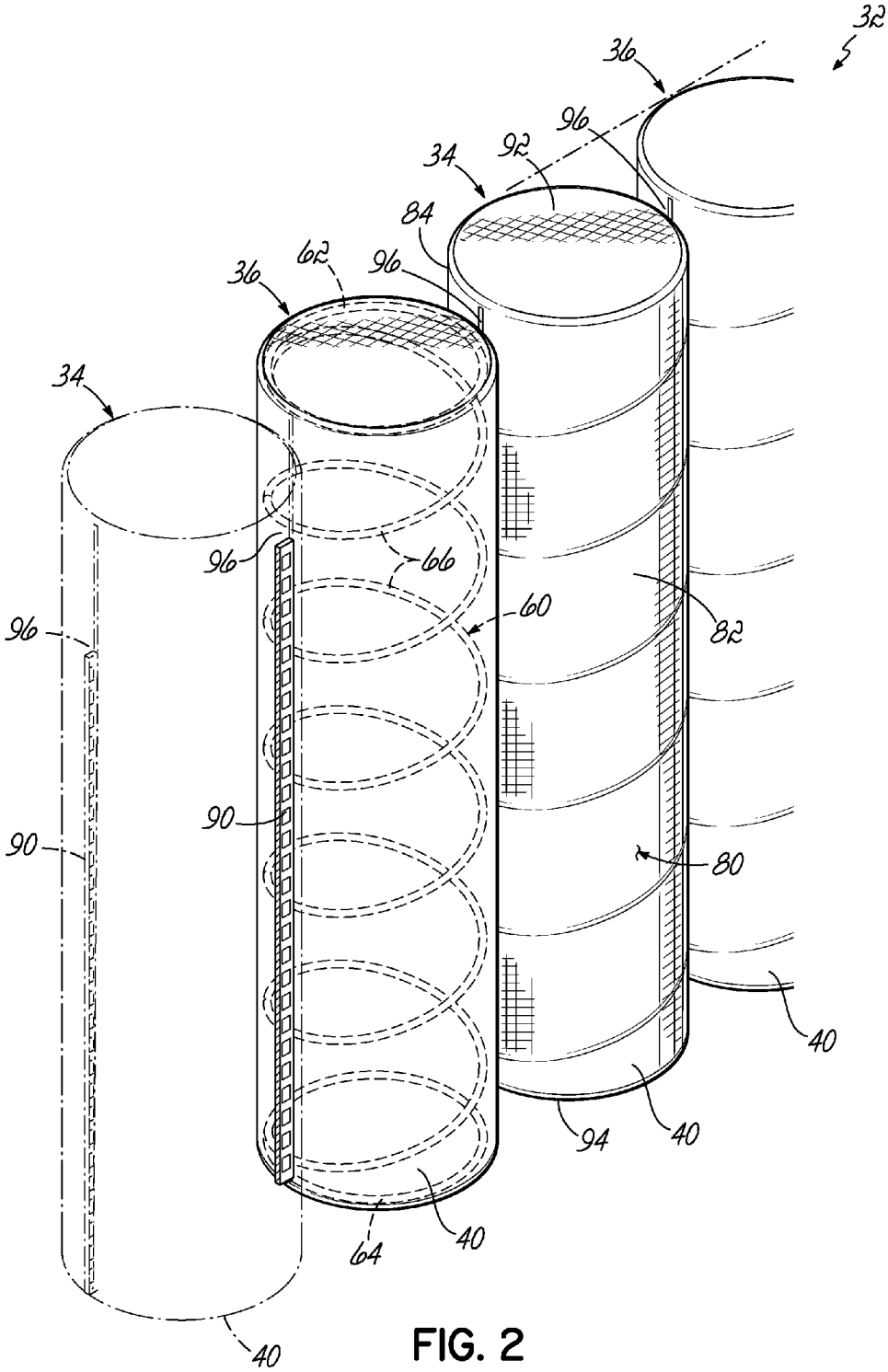
FIG. 2 is an enlarged perspective view of a portion of one of the strings of springs of FIG. 1.
Figure 3A:
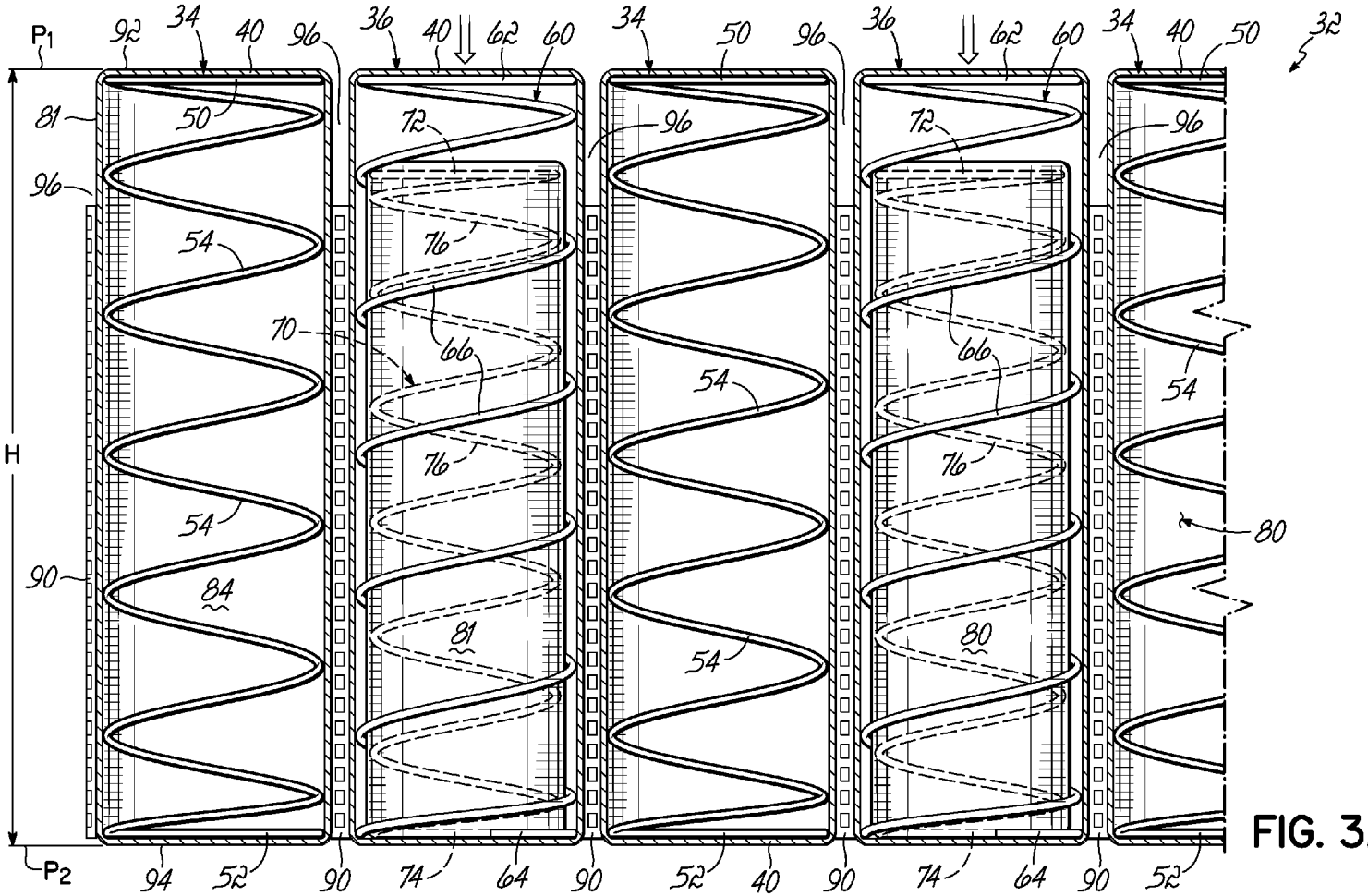
FIG. 3A is a cross-sectional view, partially broken away, of the string of springs of FIG. 2 in an unloaded condition.
Figure 3B:
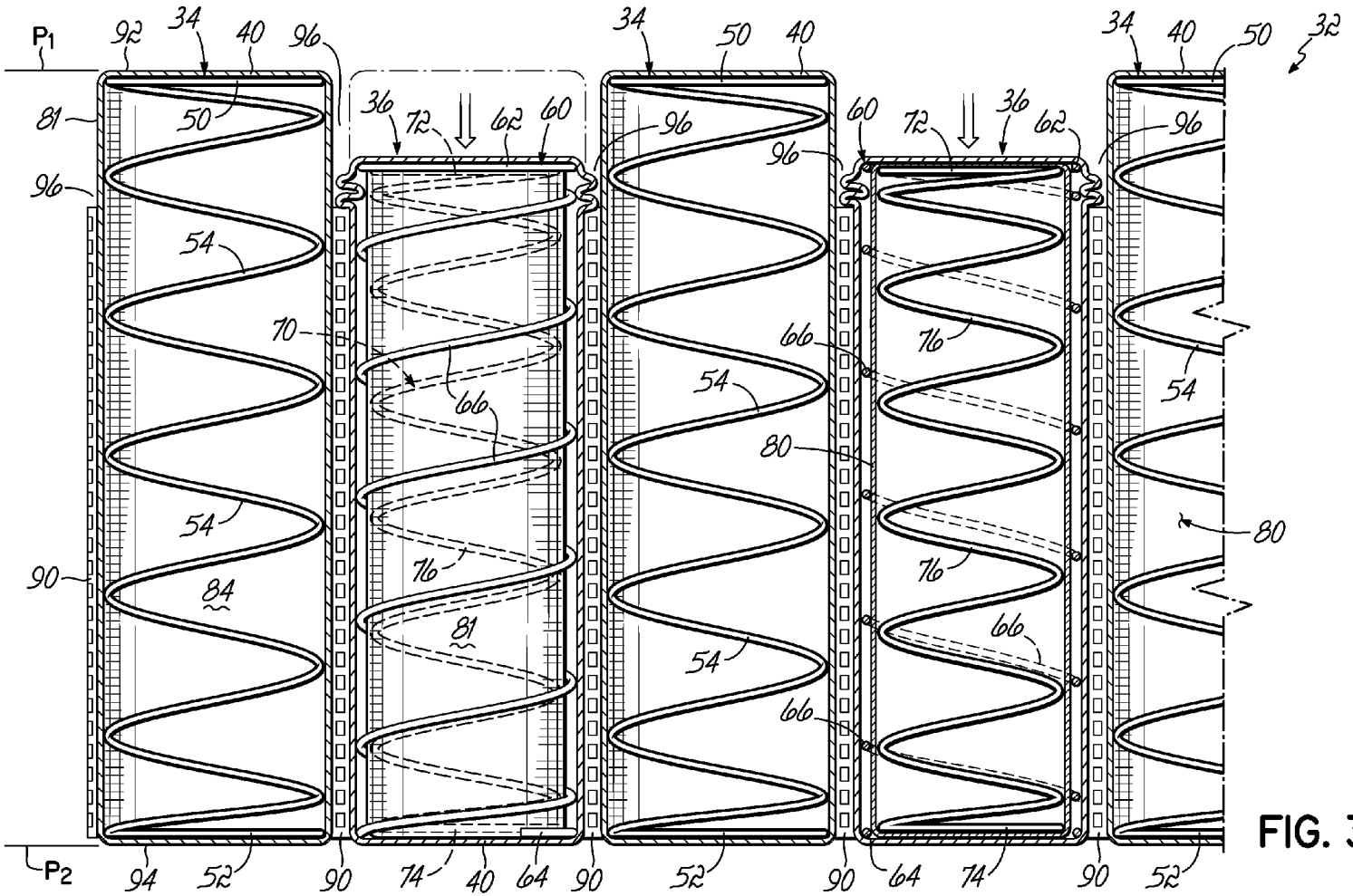
FIG. 3B is a view similar to FIG. 3A in a loaded condition.

Each string 30, 32 comprises a row of interconnected pockets. Referring to FIGS. 2, 3A, and 3B, the construction will be described in connection with string 32 of springs 34, 36. Each string 32 comprises a row of interconnected fabric pockets 40. Every other pocket 40 contains a single spring 34. Each pocket 40 between the single springs 34 contains a compound nested spring 36. The single springs 34 and compound nested springs 36 thus alternate along the length of string 32. Each spring 34 is a coil spring having an upper end turn 50, a lower end turn 52 and a plurality of central convolutions 54 between the end turns. Each compound nested spring 36 is a pair of coil springs, a taller outer coil spring 60 and a shorter inner coil spring 70. Taller outer spring 60 has an upper end turn 62, a lower end turn 64, and a plurality of central convolutions 66 between the end turns. Shorter inner spring 70 has an upper end turn 72, a lower end turn 74, and a plurality of central convolutions 76 between the end turns, and is encapsulated in its own individual fabric pocket 81. Note that the coil springs 34 and the coil springs 60 of the compound nested springs 36 can be the identical spring.

Preferably, the interconnected fabric pockets 40 are formed from a single piece of fabric 80 folded over onto itself and around the coil springs. Overlapping edges of the opposite sides or plies 82, 84 of the fabric 80 can be sewn, adhered, welded, or otherwise secured together creating a longitudinal seam (not shown). Transverse seams 90, likewise formed by sewing, adhering, welding, etc. form the individual pockets 40. Although the seams in all of the embodiments shown herein are shown as being heat welded spaced rectangles, any of the seams may be spaced dots, triangles or solid line segments without spaces. Further construction details of the pockets 40 of strings 30, 32 may be seen with reference to the Applicant's co-pending U.S. patent application Ser. No. 13/921,499 filed Jun. 19, 2013, hereby incorporated by reference herein as if fully set forth in its entirety.

Referring to FIGS. 3A and 3B, the strings 30, 32 of pocketed springs have a generally planar top or upper surface 92 in a top plane P1 and a parallel generally planar bottom or lower surface 94 in a bottom plane P2. The linear distance between the top and bottom surfaces 92, 94 of the strings 30, 32 of pocketed springs defines a height H of the strings 30, 32 of pocketed springs. This linear distance further defines the height H of the pocketed spring assembly 12 because each of the strings 30, 32 of springs has the same height. However, it is within the scope of the present invention that different strings of springs of a pocketed spring assembly have different heights.

In accordance with an embodiment of the present invention, in strings 32, the transverse seams 90 forming the adjacent pockets 40 are divided as at 96 to thereby form a cut, slit, or notch by, for example, cutting, slitting, severing, melting, or the like, from the upper surface 92 of the string 32 inwardly (downwardly as illustrated), so as to partially separate the adjacent pockets 40. Preferably, the divide 96 extends to beyond or below the upper end turn 72 of the shorter spring 70 of compound nested spring 36. By way of a non-limiting example, the shorter coil springs 70 can be 7 inches tall and the taller coil springs 60 can be 8 inches tall. In strings 30, however, the transverse seams 90 extend the full height of the strings, i.e. there is no divide 96.

The significance of divide 96 may be appreciated with reference to FIG. 3B. Divide 96 essentially decouples each compound nested spring 36 from its adjacent single springs 34 during initial deflection of compound nested spring 36. This creates more of an individual coil performance and allows the shorter coil spring 70 to engage a person sleeping on the mattress 10 sooner while giving the person a softer feel at the beginning of the coil deflections. It is believed that this arrangement provides a more comfortable product 10.

Referring now to FIG. 4, the strings 30, 32 of springs are shown in one preferable arrangement for a spring core 12 for a mattress 10. As can be seen, the strings 32 of alternating single springs 34 and compound nested springs 36 are arranged in a plurality of zones 98 on the mattress 10. By way of example, five zones 98 are illustrated, with the zones corresponding roughly to the location of a sleeper's head, shoulders, mid-section, knees, and feet. By way of further example, the two upper zones are each formed from two strings 32, the middle zone is formed from four strings 32, and the two lower zones are formed from two strings 32. The strings 32 are arranged such that the single springs 34 and compound nested springs 36 are staggered relative to one another in the longitudinal direction. The balance of the spring core is made up of strings 30 of pocketed single springs 34. Of course, other arrangements are within the scope of the invention.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A bedding or seating product comprising:

a pocketed spring assembly comprising a plurality of parallel strings of springs, each said string joined to an adjacent said string, each said string comprising first and second opposed plies of fabric and a plurality of pockets formed along a length of said string by transverse seams joining said first and second plies, and at least one spring positioned in each said pocket, at least one said string having a single spring in one said pocket and a pair of nested springs in an adjacent said pocket in alternating fashion along the length of said string, said pair of nested springs having a taller spring and a shorter spring, wherein a portion of each said transverse seam forming said adjacent pockets of said at least one string is divided from an upper surface of said at least one string downwardly to at least an uppermost portion of said shorter spring so as to partially separate said adjacent pockets, said adjacent pockets nevertheless connected along a substantial portion of a height of said shorter spring, cushioning materials on said pocketed spring assembly, and an upholstered covering encasing said pocketed spring assembly and cushioning materials.

2. The product of claim 1 wherein each said transverse seam separating said adjacent pockets of said at least one string is divided from said upper surface of said at least one string downwardly to just below an uppermost portion of said shorter spring.

3. The product of claim 2 wherein each said transverse seam forming said adjacent pockets of said at least one string is not divided from a lower surface of said at least one string upwardly.

4. The product of claim 1 wherein each said spring has upper and lower end turns and a plurality of central convolutions between said end turns.

5. The product of claim 1 wherein said strings of springs extend longitudinally.

6. The product of claim 1 wherein said strings of springs extend transversely.

7. The product of claim 6 including a plurality of said strings having a single spring in one said pocket and a pair of nested springs in an adjacent said pocket in alternating fashion along the length of said string, said plurality of said strings arranged in a plurality of zones, said zones longitudinally spaced apart.

8. The product of claim 7 wherein there are five said zones.

9. The product of claim 8 wherein said five zones comprise a central zone, a pair of head end zones, and a pair of foot end zones.

10. The product of claim 9 wherein said central zone has four said strings of springs having a single spring in one said pocket and a pair of nested springs in an adjacent said pocket in alternating fashion along the length of said strings, and each of said head end zones and foot end zones has two said strings of springs having a single spring in one said pocket and a pair of nested springs in an adjacent said pocket in alternating fashion along the length of said strings.

11. The product of claim 10 wherein said strings of springs having a single spring in one said pocket and a pair of nested springs in an adjacent said pocket in alternating fashion along the length of said strings are arranged such that said single springs and said nested springs are staggered relative to one another longitudinally.

12. A pocketed spring assembly for a bedding or seating product, said pocketed spring assembly comprising:

a plurality of parallel strings of springs, each said string joined to an adjacent said string, each said string comprising first and second opposed plies of fabric and a plurality of pockets formed along a length of said string by transverse seams joining said first and second plies, and at least one spring positioned in each said pocket, at least one said string having a single spring in one said pocket and a pair of nested springs in an adjacent said pocket in alternating fashion along the length of said string, said pair of nested springs having a taller spring and a shorter spring, wherein a portion of each said transverse seam forming said adjacent pockets of said at least one string is divided from an upper surface of said at least one string downwardly to at least an uppermost portion of said shorter spring so as to partially separate said adjacent pockets, said adjacent pockets nevertheless connected along a substantial portion of a height of said shorter spring.

13. The assembly of claim 12 wherein each said transverse seam separating said adjacent pockets of said at least one string is divided from said upper surface of said at least one string downwardly to just below an uppermost portion of said shorter spring.

14. The assembly of claim 13 wherein each said transverse seam forming said adjacent pockets of said at least one string is not divided from a lower surface of said at least one string upwardly.

15. The assembly of claim 12 wherein each said spring has upper and lower end turns and a plurality of central convolutions between said end turns.

16. The assembly of claim 12 wherein said strings of springs extend longitudinally.

17. The assembly of claim 12 wherein said strings of springs extend transversely.

18. The assembly of claim 12 including a plurality of said strings having a single spring in one said pocket and a pair of nested springs in an adjacent said pocket in alternating fashion along the length of said string, said plurality of said strings arranged in a plurality of zones, said zones longitudinally spaced apart.

19. The assembly of claim 18 including five said zones.

20. The assembly of claim 19 wherein said five zones comprise a central zone, a pair of head end zones, and a pair of foot end zones.

21. The assembly of claim 20 wherein said central zone has four said strings of springs having a single spring in one said pocket and a pair of nested springs in an adjacent said pocket in alternating fashion along the length of said strings, and each of said head end zones and foot end zones has two said strings of springs having a single spring in one said pocket and a pair of nested springs in an adjacent said pocket in alternating fashion along the length of said strings.

22. The assembly of claim 21 wherein said strings of springs having a single spring in one said pocket and a pair of nested springs in an adjacent said pocket in alternating fashion along the length of said strings are arranged such that said single springs and said nested springs are staggered relative to one another longitudinally.

23. A string of springs for a pocketed spring assembly for a bedding or seating product, said string of springs comprising:

first and second opposed plies of fabric and a plurality of pockets formed along a length of said string by transverse seams joining said first and second plies, a single spring in one said pocket and a pair of nested springs in an adjacent said pocket in alternating fashion along the length of said string, said pair of nested springs having a taller spring and a shorter spring, wherein a portion of each said transverse seam forming said adjacent pockets is divided from an upper surface of said string of springs downwardly to at least an uppermost portion of said shorter spring so as to partially separate said adjacent pockets, said adjacent pockets nevertheless connected along a substantial portion of a height of said shorter spring.

24. The string of claim 23 wherein each said transverse seam separating said adjacent pockets is divided from said upper surface of said string of springs downwardly to just below an uppermost portion of said shorter spring.

25. The string of claim 24 wherein each said transverse seam forming said adjacent pockets is not divided from a lower surface of said string of springs upwardly.

26. The string of claim 23 wherein each said spring has upper and lower end turns and a plurality of central convolutions between said end turns.

* * * * *